US011660654B2

(12) United States Patent
Anderton

(10) Patent No.: US 11,660,654 B2
(45) Date of Patent: May 30, 2023

(54) SUPER PLASTIC FORMING APPARATUS AND METHOD

(71) Applicant: GROUP RHODES LIMITED, Wakefield (GB)

(72) Inventor: Peter Anderton, Wakefield (GB)

(73) Assignee: GROUP RHODES LIMITED, Wakefield (GB)

( * ) Notice: Subject to any disclaimer, the term of this patent is extended or adjusted under 35 U.S.C. 154(b) by 0 days.

(21) Appl. No.: 16/972,733

(22) PCT Filed: May 2, 2019

(86) PCT No.: PCT/GB2019/051213
§ 371 (c)(1),
(2) Date: Dec. 7, 2020

(87) PCT Pub. No.: WO2019/234382
PCT Pub. Date: Dec. 12, 2019

(65) Prior Publication Data

US 2021/0245224 A1 Aug. 12, 2021

(30) Foreign Application Priority Data

Jun. 7, 2018 (GB) ..... 1809397

(51) Int. Cl.
*B21D 26/055* (2011.01)
*B21D 37/16* (2006.01)

(52) U.S. Cl.
CPC ..... *B21D 26/055* (2013.01); *B21D 37/16* (2013.01); *F28F 2265/12* (2013.01)

(58) Field of Classification Search
CPC ..... B21D 26/055; B21D 37/16; F28F 13/00; F28F 2265/12
See application file for complete search history.

(56) References Cited

U.S. PATENT DOCUMENTS 3,666,849 A 5/1972 Williams et al.
4,288,021 A * 9/1981 Leodolter ..... B21D 26/055 72/60
4,708,008 A * 11/1987 Yasui ..... B21D 26/055 72/38

(Continued)

FOREIGN PATENT DOCUMENTS

DE 2729093 A1 7/1978
EP 1728580 A1 12/2006

OTHER PUBLICATIONS

Tobul Gas Bottles—hydraulic accumulators (http://www.hydraulicaccumulators.net/Tobul-Gas-Bottles.html) (website accessed Sep. 16, 2021) (Year: 2014).*

(Continued)

*Primary Examiner* — Eric S Ruppert
*Assistant Examiner* — Hans R Weiland
(74) *Attorney, Agent, or Firm* — Workman Nydegger

(57) ABSTRACT

A cooling apparatus for a component formed by super plastic forming including a gas source configured to supply a gas to an interior space of the component via a gas inlet, a gas outlet configured to allow the gas to exit the interior space, and a gas column connected to the gas outlet and configured to compensate for changes in an external pressure acting on the component.

8 Claims, 4 Drawing Sheets

(56) References Cited

U.S. PATENT DOCUMENTS

| | | | | |
|---|---|---|---|---|
| 4,901,552 | A * | 2/1990 | Ginty | B21D 26/055 72/60 |
| 4,951,491 | A * | 8/1990 | Lorenz | B21D 26/055 72/38 |
| 5,419,170 | A * | 5/1995 | Sanders | B21D 26/055 72/60 |
| 5,946,802 | A * | 9/1999 | Calle | B21D 26/055 29/889.721 |
| 6,305,203 | B1 * | 10/2001 | Yasui | B21D 26/055 72/60 |
| 6,884,966 | B2 * | 4/2005 | Coleman | B21D 26/055 148/698 |
| 2003/0000275 | A1 * | 1/2003 | Spence | B21D 26/055 72/342.1 |

OTHER PUBLICATIONS

Search Report from corresponding GB Application No. GB1809397.1, dated Dec. 5, 2018.

International Search Report and Written Opinion from PCT Application No. PCT/GB2019/051213, dated Jul. 29, 2019.

* cited by examiner

100

SUPER PLASTIC FORMING APPARATUS AND METHOD

FIELD OF THE INVENTION

This invention relates to a super plastic forming apparatus and method.

BACKGROUND OF THE INVENTION

There is a demand for thin and strong metal components in a variety of complex shapes, particularly in the aerospace and automotive industries.

One method of forming such components involves heating the material to a high temperature (around 1,000° C., but varying depending on the particular material) so that it enters a "plastic" state, in which it can be easily formed and moulded to the required shape. The temperature which results in the plastic state is referred to in the art as the "transition temperature", and the method is known as "super plastic forming" (SPF).

In addition, when sheets of the material are heated to their transition temperature, they can be bonded together by the application of a load such as a clamping force. This bonding process is known as "diffusion bonding" (DB), and can provide a homogenous joint between the sheets.

In one example method, components—particularly substantially hollow components—are formed by placing two or more layers of material in a die or mould. The layers are heated to the transition temperature and then clamped at a plurality of bonding zones, so that the layers are diffusion bonded at the bonding zones. High pressure gas, such as Argon, is then introduced between the layers, forcing apart the layers in the non-bonded areas. As the layers are forced apart, the material conforms to the shape of the mould, thereby resulting in a component of the desired shape. This method allows for the accurate production of complex shapes, and the use of more than two layers enables the formation of thin internal section walls.

Typically, the components are removed from the mould or die immediately after the forming process is complete (i.e. when the material is still in a plastic state), so that production is maintained at a relatively high speed. However, difficulties can arise during the removal of the component from the mould and during the subsequent cooling of the component.

In particular, thin sections of material (for example 0.5 mm to 1 mm thick) having a large surface area (for example over 1 $m^2$) are susceptible to distortion. Furthermore, during cooling, and particularly between the transition temperature and a temperature at which the material stabilises (hereinafter referred to as the "stabilisation temperature" and typically around 550° C., but varying depending on the particular material), any differential between the internal and external pressures acting on the newly-formed component can result in relatively large forces acting on the component. Accordingly, distortion may result.

A further difficulty occurs during cooling, in that any oxygen entering the internal cavities of the component causes oxidisation of the material.

It is an aim of the present invention to address at least some of the above difficulties, or other difficulties which will be appreciated from the description below. It is a further aim of the present invention to provide apparatuses and methods which allow for the rapid, accurate and reliable production of super plastically formed components.

SUMMARY

According to a first aspect of the present invention, there is provided a cooling apparatus for a component formed by super plastic forming comprising:

- a gas source configured to supply a gas to an interior space of the component via a gas inlet;
- a gas outlet configured to allow the gas to exit the interior space, and
- a gas column connected to the gas outlet and configured to compensate for changes in an external pressure acting on the component.

Preferably, the gas is an inert gas. More preferably, the gas is argon. Preferably the gas source is configured to supply the gas until the component cools to a stabilisation temperature. Advantageously, the inert gas prevents the oxidisation of the interior space of the component during cooling.

Preferably the gas inlet is a pipe or tube connected to an inlet hole in the component. More preferably, the inlet hole is a pre-existing hole through which gas was introduced during super plastic forming.

Preferably, the component is formed from a metal. More preferably, the component is formed from titanium. The component may instead be formed from aluminium.

Preferably, the gas column is a substantially vertically aligned structure, wherein a, preferably vertical, height of the gas column is greater than a width of the gas column. Preferably, the gas column is at least partially filled with a gas, preferably the same gas as is supplied by the gas source. Preferably, a weight of the gas in the gas column exerts a pressure in a downward direction. Preferably, the gas column acts to ensure that an internal pressure, preferably exerted by the gas on the interior space, is substantially equal to the external pressure acting on an exterior surface of the component. Preferably, the external pressure is an ambient atmospheric pressure.

Preferably, the gas column comprises an opening at an upper portion thereof, so that the external pressure acts on an upper surface of the gas in the gas column. Preferably, the opening is open to the atmosphere. More preferably, the opening is at an uppermost point of the gas column. Preferably, the gas in the gas column has a higher density than air. Advantageously, excess internal pressure in the component is vented via the gas column. Advantageously, an increase in the external pressure is compensated for by an increase in internal pressure in the component caused by the weight of the gas in the gas column.

Preferably, the height of the gas column is calculated based on a volume of the interior space of the component. Preferably, the height of the gas column is calculated based on an expected upper limit of the atmospheric pressure. Preferably, the height of the gas column is calculated based on an expected lower limit of the atmospheric pressure. Preferably, the height of the gas column is calculated based on a change in a density of the gas during cooling. Advantageously, the height of the gas column may be adjusted for the cooling of different components.

Preferably, the apparatus further comprises a control valve, configured to control the exit of the gas from the apparatus. More preferably, the control valve is connected to the gas outlet 112.

Preferably, the gas column is connected to the gas outlet at a position between the component and the control valve.

According to a second aspect of the present invention, there is provided a pressure equalising device for a cooling apparatus comprising:

a gas outlet connectable to an interior space of a component, and a gas column connected to the gas outlet and configured to compensate for changes in an external pressure acting on the component.

Further preferred features of the components required in the device of the second aspect are defined hereinabove in relation to the first aspect and may be combined in any combination.

According to a third aspect of the present there is provided a super plastic forming apparatus for forming a component comprising:

a heating means configured to heat a plurality of sheets of material, each sheet comprising at least one bonding zone;

a mould corresponding to the desired shape of the component and configured to receive the plurality of sheets;

a first gas source configured to introduce a first gas between the plurality of sheets, so that the plurality of sheets are forced apart in areas other than those corresponding to the at least one bonding zone, so as to conform to the shape of the mould;

a second gas source configured to supply a second gas to an interior space of the component via a gas inlet;

a gas outlet configured to allow the second gas to exit the interior space, and a gas column connected to the gas outlet and configured to compensate for changes in an external pressure acting on the component.

Further preferred features of the components required in the apparatus of the third aspect are defined hereinabove in relation to the first and second aspects and may be combined in any combination.

According to a fourth aspect of the present invention, there is provided a method of cooling a component formed by super plastic forming comprising:

supplying a gas to an interior space of the component;

allowing the gas to exit the interior space via an outlet, and compensating for changes in an external pressure acting on the component using a gas column connected to the outlet.

Further preferred features of the components required in the method of the fourth aspect are defined hereinabove in relation to the first, second and third aspects and may be combined in any combination.

BRIEF DESCRIPTION OF THE DRAWINGS

For a better understanding of the invention, and to show how embodiments of the same may be carried into effect, reference will now be made, by way of example, to the accompanying diagrammatic drawings in which:

FIG. 1(*b*) is a cross sectional view of an example super plastic forming process involving three layers;

DETAILED DESCRIPTION

Figure 1A:
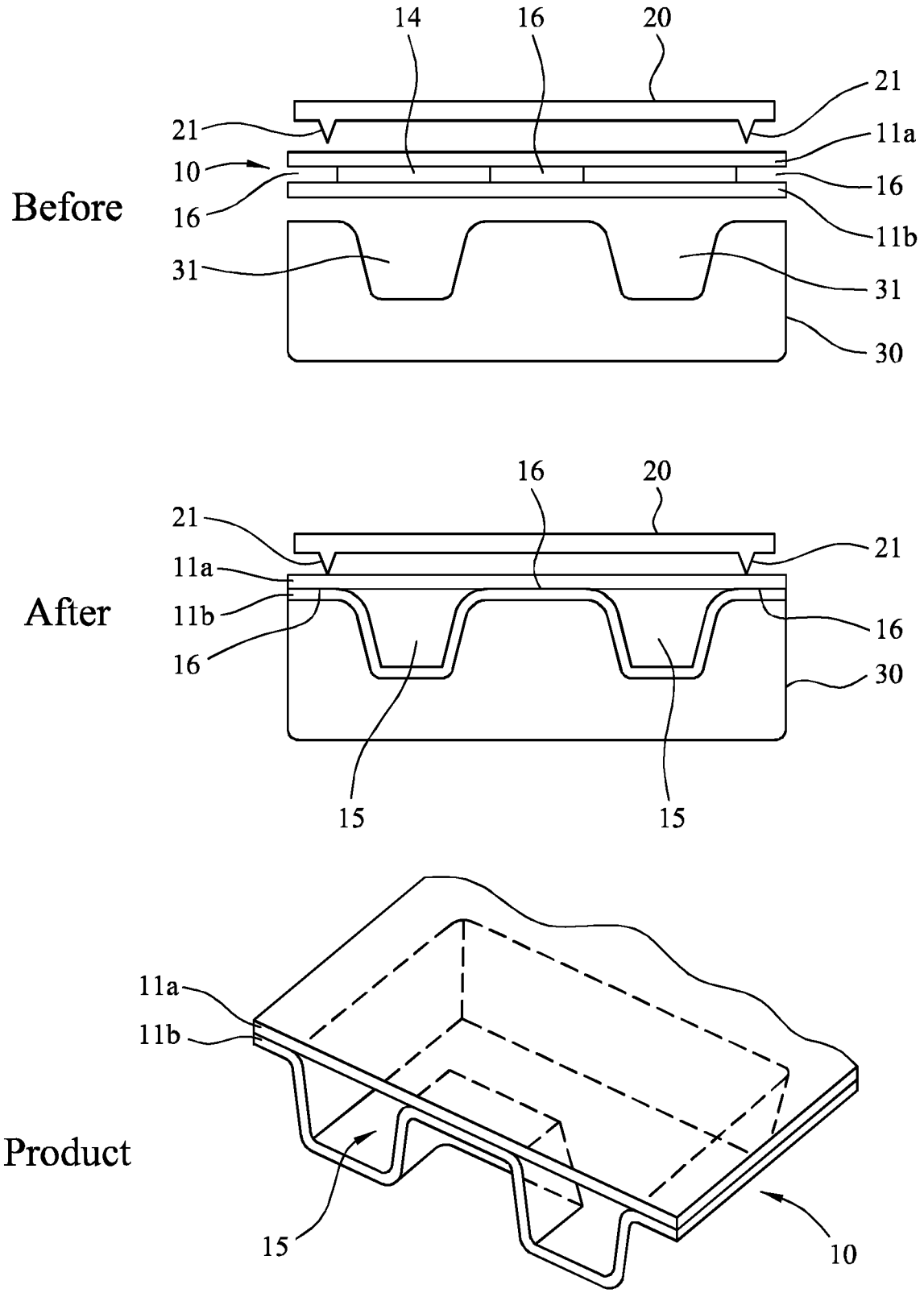
FIG. 1(*a*) is a cross sectional view of an example super plastic forming process involving two layers.
Figure 1B:
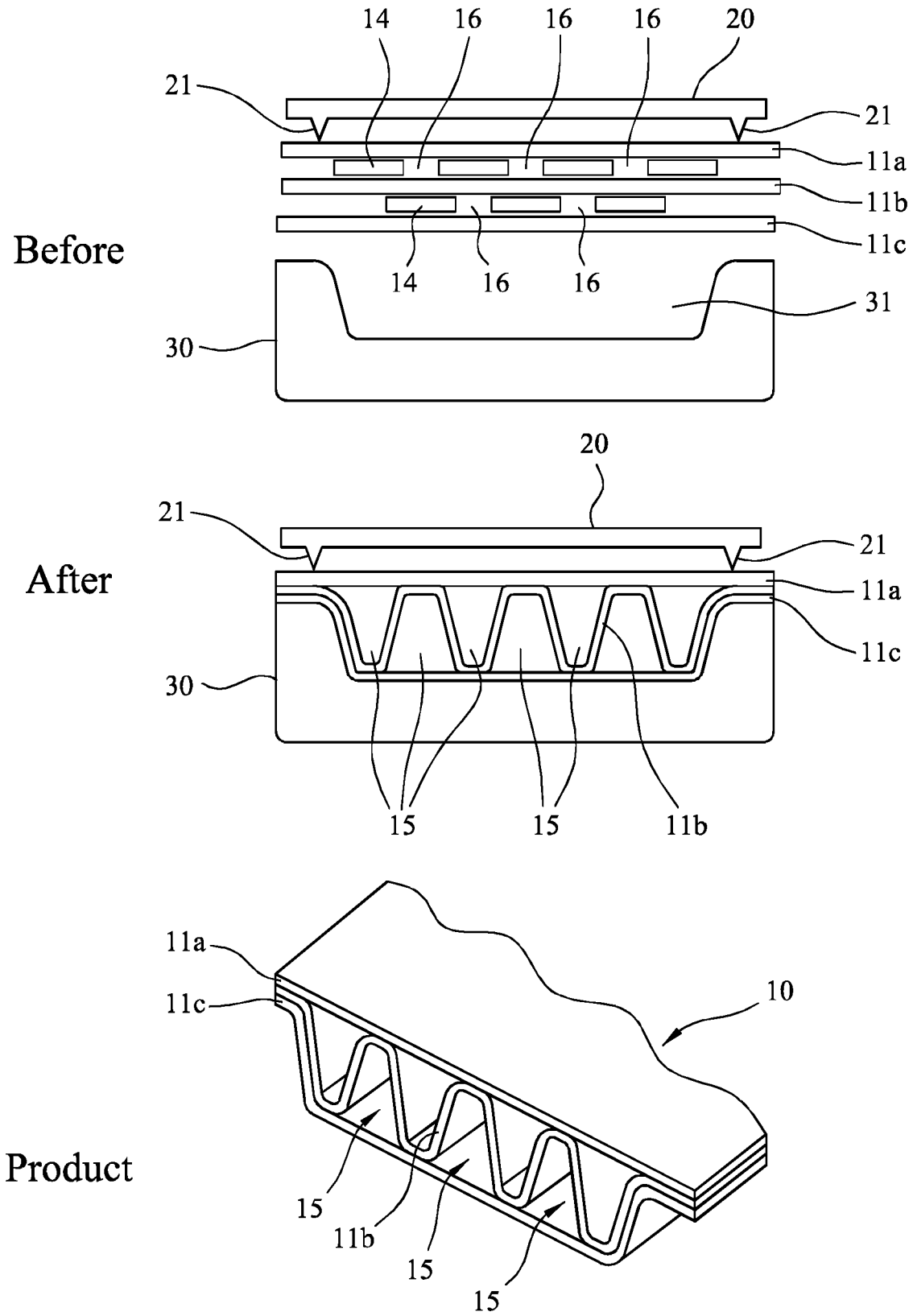

FIG. 1(*a*) illustrates a method of super plastic forming a component 10, showing the materials before and after forming, and the resulting component 10. In FIG. 1(*a*), the component 10 is formed from two sheets of material: an upper sheet 11*a* and a lower sheet 11*b*. In one example, the sheets 11 are formed from titanium. In further examples, the sheets 11 are formed from aluminium.

A plurality of bonding zones 16 are defined on the sheets 11, at which the sheets 11 are to be diffusion bonded together. In one example, the bonding zones 16 are defined by applying a coating 14 to either or both of the sheets 11 in the areas of the sheets 11 which are not to be diffusion bonded. Particularly, the coating 14 is applied to the surfaces of the sheets 11 which are disposed facing each other during the forming process. In other words, the coating is applied to either or both of the lower surface of the upper sheet 11*a* and the upper surface of the lower sheet 11*b*. The coating 14 therefore acts as a mask, defining the bonding zones 16. In one example, the coating 14 is applied to the or each sheet 11 using screen printing.

The sheets 11 are heated to the transition temperature of the material using a suitable heating means. For example, the heating means may comprise a platen which is heated using an electrical resistance heating system. When the sheets enter a plastic state which allows them to be easily moulded and formed, as well as allowing them to be diffusion bonded. In examples where the sheets 11 are formed from titanium, the transition temperature is around +925° C. In examples where the sheets 11 are formed from aluminium, the transition temperature is around +495° C.

The heated sheets 11 are then placed in a mould 30 or a die. The mould 30 defines one or more recesses 31, which correspond to the desired shape of the finished product 10. A clamp 20 applies a force at one or more clamping points 21 to secure the heated sheets 11 in the mould.

Once secured within the mould 30, a gas is introduced at high pressure between the sheets 11. The gas is supplied by a suitable gas source. In one example, the gas is an inert gas. In one example, the gas is argon. In one example, the gas is introduced via a small, needle-like tube inserted between the sheets 11. In one example the gas is introduced between the sheets at a pressure of approximately 6 Megapascals (60 bars).

The gas forces apart the sheets 11 in the non-bonded areas (i.e. the areas where the coating 14 has been applied). Accordingly, the sheets 11 effectively inflate within the mould 30, with the gas causing the sheets 11 to conform to the shape of recesses 31 of the mould 30. The resulting component 10 comprises one or more internal spaces or cavities 15 in the non-bonded areas between the sheets 11.

FIG. 1(*b*) shows a similar method of super plastic forming a component 10. However, in FIG. 1(*b*), the component 10 is formed from three sheets 11: an upper sheet 11*a*, a lower sheet 11*c*, and a middle sheet 11*b* disposed between the upper sheet 11*a* and the lower sheet 11*c*.

In the example shown in FIG. 1(*b*), bonding zones 16 are defined on the surfaces of the sheets 11 which are disposed facing another one of the sheets 11. In other words, the coating 14 is applied to either or both of the lower surface of the upper sheet 11*a* and the upper surface of the middle sheet 11*b*. The coating 14 is also applied to either or both of the lower surface of the middle sheet 11*b* and the upper surface of the lower sheet 11*c*.

The sheets 11 are heated and clamped in the mould 30 in a similar way to that described above with reference to FIG. 1(*a*). Again, the gas is introduced at high-pressure between the sheets 11, and the outer sheets 11*a* and 11*c* conform to shape of the mould 30. The gas causes the middle sheet 11*b* to form internal sectional walls within the component 10, defining a plurality of cavities 15 therebetween.

It will be understood by those skilled in the art that the number of sheets 11, the number and position of the bonding zones 16, and the shape of the mould 30 may be varied according to the desired shape and internal structure of the resulting component.

In one example, the component 10 is formed using a super plastic forming apparatus comprising the heating means, the mould and the gas source.

Figure 2:
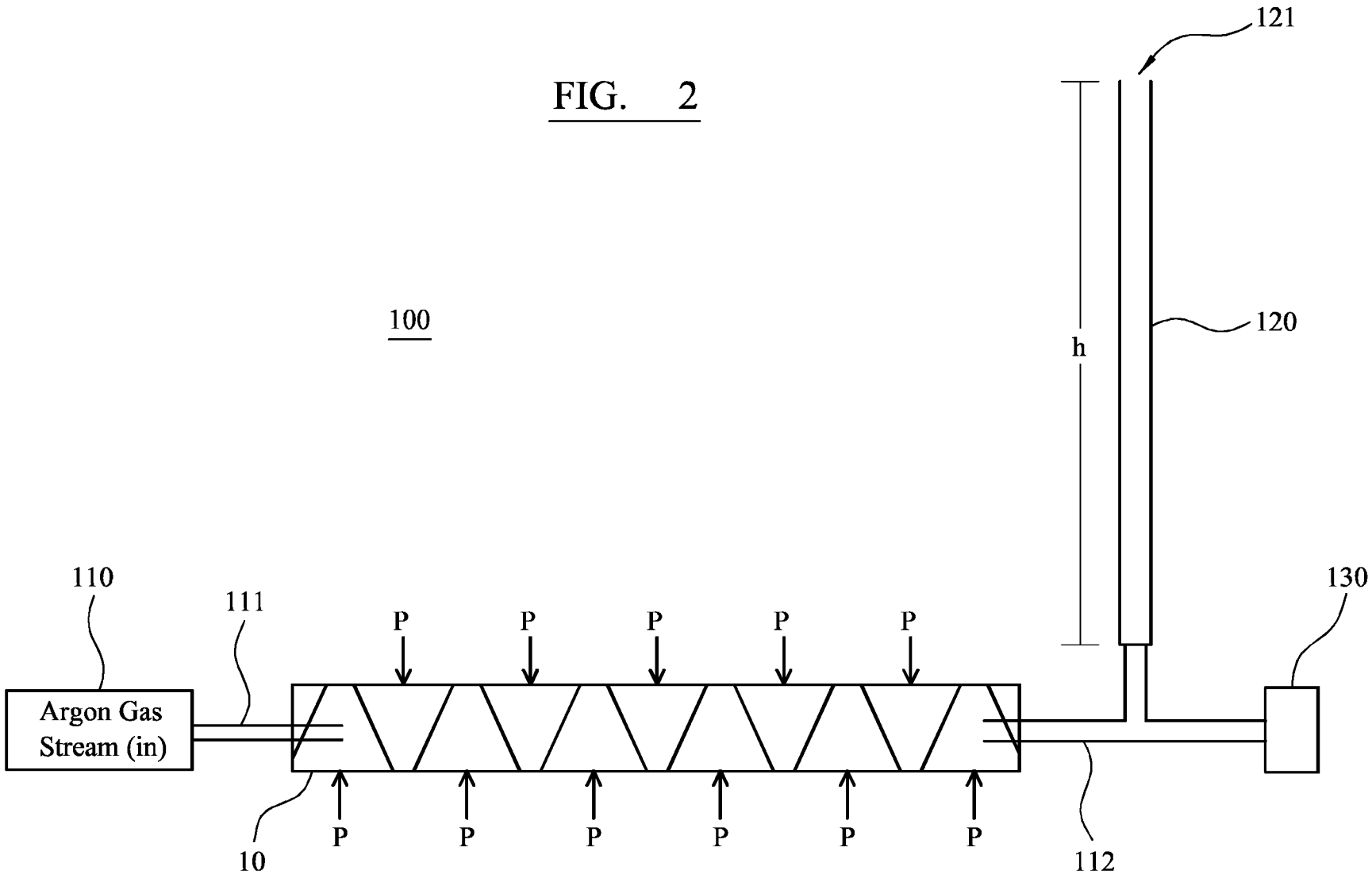
FIG. 2 is a schematic view of an example cooling apparatus for a component formed by super plastic forming.

Once formed, the component 10 is removed from the mould 30 whilst still hot, and then cooled using a cooling apparatus 100, which is described below with reference to FIG. 2. It will be understood that, in further examples, the super plastic forming apparatus comprises the cooling apparatus 100. In such examples, the component 10 may be cooled in the mould 30, rather than after removal from the mould 30.

The cooling apparatus 100 comprises a gas source 110, a gas inlet 111, a gas outlet 112 and a gas column 120.

The gas source 110 is configured to supply a gas to the interior space 15 of the component 10 via the gas inlet 111. In one example, the gas is an inert gas. In one example, the gas is argon. In one example, the gas inlet 111 is a pipe or tube connected to an inlet hole in the component 10. The inlet hole may be the same inlet through which gas was introduced at high-pressure between the sheets 11 during the above-described super plastic forming.

The gas outlet 112 is configured to allow the gas to exit the interior space 15 of the component 10. Accordingly, a stream of gas is passed through the component 10 during cooling. In one example, the stream of gas is supplied until the component has reached the stabilisation temperature. In an example where the component is formed from titanium, the stabilisation temperature is approximately +550° C. The supply of gas prevents air entering the interior space 15 of the component, thereby preventing oxidisation caused by the hot internal surfaces of the component 10 reacting with oxygen in the air.

The supply of the gas to the interior space 15 of the component 10 exerts a pressure on the interior space 15, hereinafter referred to as the internal pressure. At the same time, an external pressure P acts on the outer surfaces of the component. Typically, this external pressure is the ambient atmospheric pressure. It will however be understood that the cooling apparatus may be situated in an environment where the external pressure is not the ambient atmospheric pressure, but is instead a different external pressure is maintained.

It will be understood that the external pressure P varies according to climatic conditions. If the internal pressure and the external pressure P are not equal during cooling, the component 10 may deform or distort.

The gas column 120 is connected to the gas outlet 112, and acts to equalise the internal pressure and external pressure P. The gas column 120 is a substantially vertically aligned structure, having a height h greater than the width of the column. The vertical orientation of the gas column 120 results in gravity acting on the gas contained therein, the weight of the gas thereby providing a pressure in a downward direction.

In one example, the gas column 120 is filled with the same gas which is supplied by the gas source 110. The gas column 120 is open to the atmosphere at an uppermost point 121. The gas contained in the gas column 120 has a higher density than air, and so is not contaminated by the oxygen in the air, and nor does the gas in the column 120 escape. For example, argon gas has a density of approximately 1.6 $kg/m^3$ compared to air, which has a density of approximately 1.2 $kg/m^3$.

In one example, the height h of the gas column 120 is calculated to achieve a desired pressure at the base of the column.

In one example, the apparatus 100 also comprises a control valve 130. The control valve 130 is connected to the gas outlet 112, and is configured to control the exit of the gas from the apparatus 100. In one example, the gas column 120 is connected to the outlet 112 at a position between the component 10 and the control valve 130.

In use, the component 10 is connected to the inlet 111 and the outlet 112. The gas source 110 supplies gas to the interior space 15 of the component 10, so that a gas stream is passed through the interior space 15. The gas passes out of the component 10 via the outlet 112, and out of the apparatus via the control valve 130.

In use, any variation in the external pressure P is compensated for by the gas column 120, thereby ensuring that the internal and external pressures remain substantially equal. If the external pressure P reduces, the excess internal pressure is vented from the upper end 112 of the column 120. If, on the other hand, the external pressure P increases, the weight of the gas in gas column 120 acts to increase the internal pressure. Accordingly, the effects of variation in ambient pressure are minimised.

Figure 3:
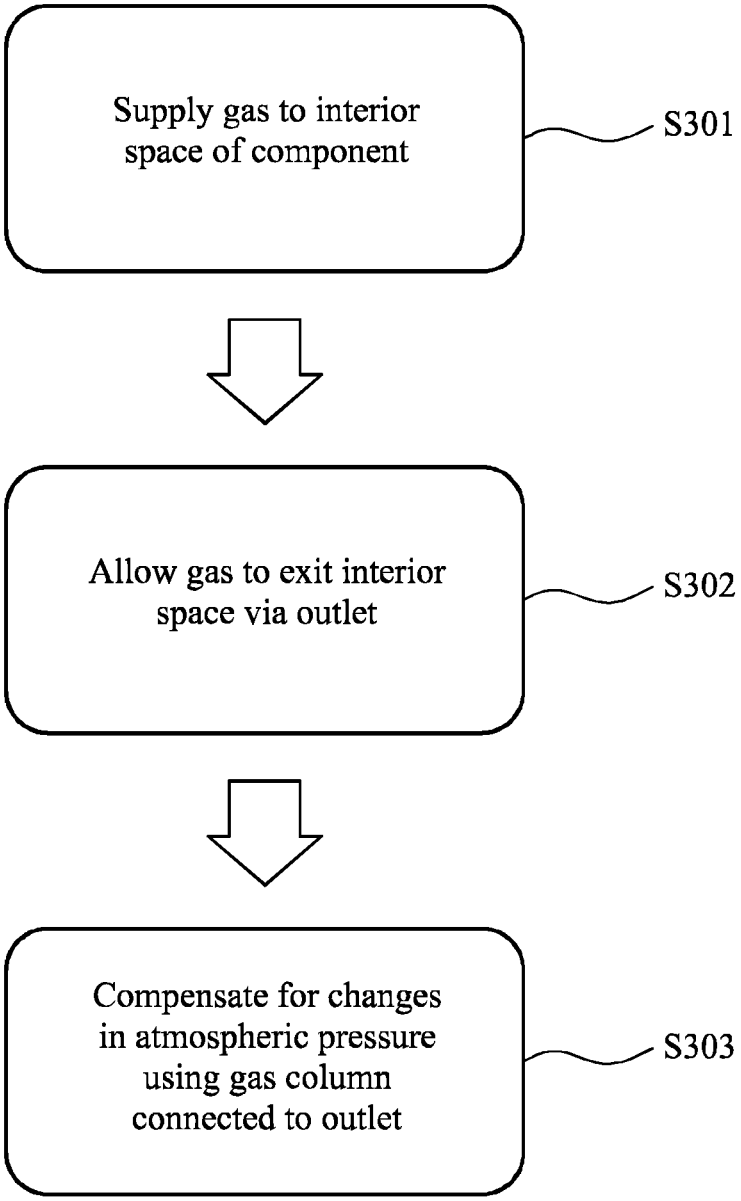
FIG. 3 shows a flowchart of an exemplary method of cooling a component formed by super plastic forming.

FIG. 3 shows a flowchart of an example method.

The method comprises a first step S301 of supplying a gas to the interior space 15 of the component 10. The method comprises a second step S302 of allowing the gas to exit the interior space 15 via the outlet 112. Accordingly, a stream of the gas is supplied to the interior of the component. The method further comprises a step S303 of compensating for changes in atmospheric (i.e. external) pressure P using a gas column 120 connected to the outlet 112. Accordingly, the internal and external pressures acting on the component remain substantially equal.

The above-described apparatuses and methods provide an advantageous method of cooling a component formed by super plastic forming. Such components, and particularly components having a large surface area compared to the thickness of the material from which they are formed, are susceptible to distortion during cooling caused by a difference in the internal and external pressures acting on the component. The above-described apparatuses and methods provide a simple and cost-effective way of compensating for changes in the external pressure acting on the component, for example due to changes in climactic conditions. Accordingly, the need for expensive, complicated and fragile control systems and valves is obviated.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A cooling apparatus for a component formed by super plastic forming, the cooling apparatus comprising:

a gas source configured to supply a supplied gas to an interior space of the component via a gas inlet;

a gas outlet configured to allow the gas to exit the interior space; and a gas column connected to the gas outlet at a connection point, the gas column being configured to compensate for changes in an external pressure acting on the component, wherein the gas column is a substantially vertically aligned structure and at least a portion of gas column is at a greater height than the connection point of the gas column and the gas outlet, wherein a vertical height of the gas column is greater than a width of the gas column, and wherein the gas column is at least partially filled with a column gas.

2. The cooling apparatus as claimed in claim 1, wherein the gas source is configured to supply the supplied gas until the component cools to a stabilisation temperature.

3. The cooling apparatus as claimed in claim 1, wherein the gas inlet is a pipe or tube connected to an inlet hole in the component.

4. The cooling apparatus as claimed in claim 3, wherein the inlet hole is a pre-existing hole adapted to have the supplied gas introduced therethrough during super plastic forming.

5. The cooling apparatus as claimed in claim 1, wherein the column gas at least partially filling the gas column is the same gas as the supplied gas supplied by the gas source.

6. The cooling apparatus as claimed in claim 1, wherein the gas column comprises an opening at an upper portion thereof and the external pressure acts on an upper surface of the column gas in the gas column.

7. The cooling apparatus as claimed in claim 1, wherein the column gas in the gas column has a higher density than air.

8. The cooling apparatus as claimed in claim 1, further comprising a control valve configured to control the exit of the supplied gas or the column gas from the apparatus.

* * * * *